United States Patent [19]

Metrailer et al.

[11] 4,366,048

[45] Dec. 28, 1982

[54] FLUID COKING WITH THE ADDITION OF SOLIDS

[75] Inventors: William J. Metrailer; Steven Wiechert, both of Baton Rouge, La.

[73] Assignee: Exxon Research and Engineering Co., Florham Park, N.J.

[21] Appl. No.: 281,918

[22] Filed: Jul. 9, 1981

[51] Int. Cl.[3] ..... C10G 9/00

[52] U.S. Cl. ..... 208/127

[58] Field of Search ..... 208/127

[56] References Cited

U.S. PATENT DOCUMENTS

| | | | |
|---|---|---|---|
| 2,888,398 | 5/1955 | Griffin, Jr. | 208/127 |
| 3,162,593 | 12/1964 | Persyn | 208/127 |
| 3,278,412 | 10/1966 | Brown . | |
| 3,414,504 | 12/1968 | Oldweiler | 208/127 |
| 3,617,513 | 11/1971 | Wilson et al. . | |
| 3,876,526 | 4/1975 | Mulasky et al. | 208/127 X |
| 3,926,783 | 12/1975 | Wolk | 208/127 X |
| 4,075,079 | 2/1978 | Lang . | |
| 4,113,602 | 9/1978 | Gorbaty et al. . | |
| 4,169,038 | 9/1979 | Metrailer et al. . | |
| 4,178,227 | 12/1979 | Metrailer et al. . | |
| 4,204,943 | 5/1980 | Metrailer et al. . | |
| 4,229,283 | 10/1980 | Sosnowski . | |
| 4,269,696 | 5/1981 | Metrailer . | |

FOREIGN PATENT DOCUMENTS

| | | |
|---|---|---|
| 1070634 | 1/1980 | Canada . |

*Primary Examiner*—Delbert E. Gantz
*Assistant Examiner*—Glenn A. Caldarola
*Attorney, Agent, or Firm*—Marthe L. Gibbons

[57] ABSTRACT

A fluid coking process is provided in which inert particles, such as coke, are added to the coker feed, in a specified amount.

9 Claims, 1 Drawing Figure

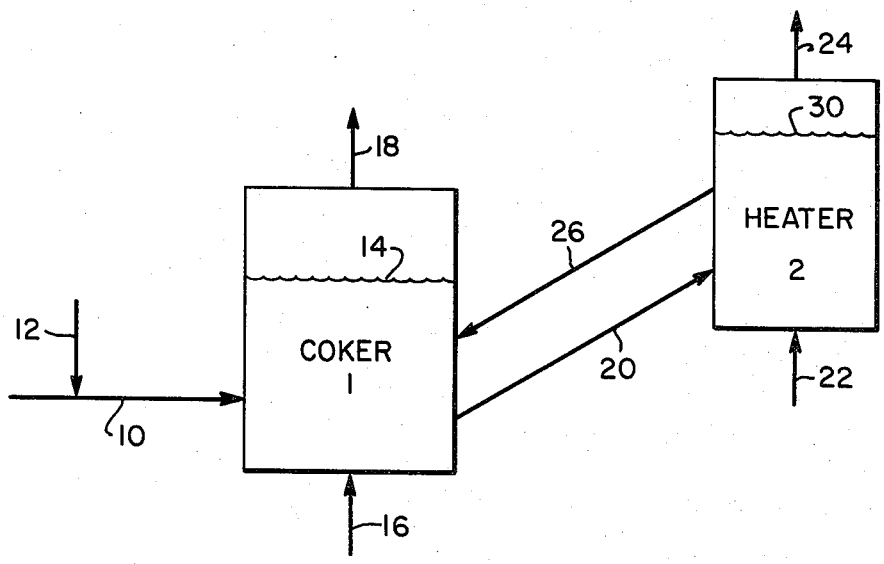
24
30
18
HEATER
2
26
14
12
COKER
1
20
22
10
16

FLUID COKING WITH THE ADDITION OF SOLIDS

BACKGROUND OF THE INVENTION

1. Field of the Invention

This invention relates to an improvement in a fluid coking process. More particularly, this invention relates to a fluid coking process in which inert solids are added to the chargestock in a specified amount.

2. Description of the Prior Art

Fluid coking is a well known process which may be carried out with or without recycle of the heavier portion of the fluid coking zone effluent. As is well known in the art, the fluid coking process, as shown for example, in U.S. Pat. No. 2,881,130, which is hereby incorporated by reference, uses a fluid coking vessel and an external heating vessel. A fluid bed of solids, preferably coke particles produced by the process having a size in the range from about 40 to about 1000 microns is maintained in the coking zone by the upward passage of fluidizing gas, usually steam, injected at a superficial velocity usually between 0.3 and 5 feet per second. The temperature in the fluid coking bed is maintained in the range of about 850° to about 1400° F., preferably between 900° and 1200° F. by circulating solids (coke) to the heating vessel and back. The heavy oil to be converted is injected into the fluid bed and upon contact with the hot solids undergoes pyrolysis evolving higher hydrocarbon products in vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. The feed rate and temperature are controlled to maintain the bed in a fluidized state. Product vapors, after removal of entrained solids, are withdrawn overhead from the coking zone and sent to a scrubber and fractionator for cooling and separation. The end boiling point of distillate fractions obtained from the process is usually about 1050° F. to about 1200° F. and the remaining heavy ends are usually recycled to extinction.

It is also known to add solid particles to the coker feedstock or to subject hydrocarbonaceous oils comprising solid particles to pyrolysis (e.g. coking).

U.S. Pat. No. 3,414,504 discloses recycling coke particles directly to the coker or in admixture with the oil feed.

Canadian Pat. No. 1,070,634 discloses recycling wet coke fines into the coker oil feed.

U.S. Pat. No. 3,278,412 discloses recycling coke-free tar sand fines to a coking zone.

U.S. Pat. No. 3,617,513 discloses recycling coal liquefaction bottoms which comprise unconverted coal, and mineral matter, as feed to a fluid coker.

U.S. Pat. No. 4,075,079 discloses utilizing as coker feed a mixture of fresh coal and coal liquefaction bottoms.

U.S. Pat. No. 4,113,602 discloses blending from about 0.1 to 5 parts by weight of fines derived from gasification of carbonaceous solids and a heavy oil and coking the mixture.

U.S. Pat. No. 4,204,943 discloses a combination of hydroconversion, coking and gasification process. Solids of less than about 10 microns in size such as coke, coal, carbonaceous residue from gasification, are added to the hydroconversion stage. The bottoms of the hydroconversion stage, which comprise solids, are introduced into the coker as feed. See also U.S. Pat. No. 4,178,227.

U.S. Pat. No. 4,169,038 discloses hydroconversion utilizing fines recovered from gasification of coke and introducing the bottoms, including the solids, of the hydroconversion zone into the coker.

U.S. Pat. No. 4,229,283 discloses fluid hydrocoking with the addition of dispersible metal compounds in the coker feed. Metallic ashes recovered from the gasification of the coke are recycled to the coker feed.

U.S. Pat. No. 4,269,696 discloses the addition of cracking catalyst particles to a coker chargestock.

It has now been found that the addition of inert solids to a hydrocarbonaceous oil feed in a specified proportion will permit conducting the fluid coking reaction at a lower temperature at a constant feed rate or will permit an increase in feed rate at a constant temperature.

SUMMARY OF THE INVENTION

In accordance with the invention there is provided, in a fluid coking process comprising the steps of: contacting a hydrocarbonaceous oil chargestock having a Conradson carbon content of at least about 5 weight percent with hot fluidized solids in a fluidized coking bed contained in a fluid coking zone maintained in a fluidized state by the introduction of a fluidizing gas and operated at coking conditions, to produce a vapor phase product and a solid carbonaceous material which deposits on said fluidized solids, the improvement which comprises adding to said chargestock inert solid particles in an amount sufficient to provide from about 2 to about 10 weight percent total solids, based on said oil.

BRIEF DESCRIPTION OF THE DRAWINGS

The FIGURE is a schematic flow plan of one embodiment of the invention.

DESCRIPTION OF THE PREFERRED EMBODIMENT

Referring to the FIGURE, a hydrocarbonaceous oil chargestock having a Conradson carbon content of at least about 5 weight percent is passed by line 10 into a coking zone 1 in which is maintained a fluidized bed of solids (e.g. coke particles of 40 to 1000 microns in size) having an upper level indicated at 14. Suitable hydrocarbonaceous oils for the present invention include heavy hydrocarbonaceous oils, heavy and reduced petroleum crude, atmospheric residuum, vacuum residuum, pitch, asphalt, bitumen, other heavy hydrocarbon residue. The hydrocarbonaceous oils may be derived from petroleum, tar sand oil, shale oil, etc. and mixtures thereof. Typically, the hydrocarbonaceous oil chargestocks have a Conradson carbon content of at least 5 weight percent, generally from about 5 to about 50 weight percent, preferably above 7 weight percent (as to Conradson carbon residue, see ASTM Test D-189-65), and typically a high content of metal contaminants.

Inert solid particles are added to the hydrocarbonaceous oil chargestock by line 12 in an amount sufficient to provide from about 2 to about 10 weight percent, preferably from about 2 to about 5 weight percent total solids, based on the oil in the chargestock. By the term "total solids" is intended herein that if the oil already comprises solids, a sufficient amount of inert solid particles would be added to bring the total solid content of the oil to the stated range. Suitable particle sizes of the added inert solids include a size below about 74 microns in diameter, preferably below about 44 microns, more preferably an average particle size of about 10 microns in diameter. The inert solids may be any solid material that will not adversely affect the operation of the fluid coking process. Suitable inert solids include coke derived from coking hydrocarbonaceous oils (such as petroleum coke, shale oil coke, tar sand oil coke, etc.), siliceous materials (e.g. inert silica) and mixtures thereof. Preferably the inert solid is coke derived from the process itself, that is, if petroleum oil is coked, then it would be petroleum coke or if shale oil is coked it would be shale coke, etc.

For the purpose of the present invention, the solids need only be inert, however, it should be understood that catalytic components may be added to the feed or be present in the coking zone for other purposes, provided that a sufficient amount of small particles be added to the coker feed.

A fluidizing gas is admitted to the coking reactor 1 by line 16 in an amount sufficient to maintain a superficial gas velocity in the range of about 0.3 to about 5 feet per second. The fluidizing gas may comprise steam, gaseous hydrocarbons, vaporized normally liquid hydrocarbons, hydrogen, hydrogen sulfide, and mixtures thereof. Typically, the fluidizing gas used will comprise steam. Coke at a temperature above the coking temperature, for example, at a temperature of 100 to 800 Fahrenheit degrees in excess of the actual operating temperature of the coking zone is admitted to coker 1 by line 26 in an amount sufficient to maintain the coking temperature in the range of about 850° to about 1400° F., preferably in the range of about 900° to about 1200° F. The total pressure in the coking zone is maintained in the range of about 0 to about 150 pounds per square inch gauge (psig), preferably in the range of about 5 to about 100 psig. The lower portion of the coker serves as a stripping zone to remove occluded hydrocarbons from the solids. A stream of solids is withdrawn from the coking zone by line 20 and circulated to heater 2. The vaporous products include gaseous hydrocarbons and normally liquid hydrocarbons as well as other gases which were introduced into the coker as fluidizing gas. The vapor phase product is removed from coker 1 by line 18 for scrubbing and fractionation in a conventional way. If desired, at least a portion of the vaporous effluent may be recycled to the coker as fluidizing gas. A stream of heavy material condensed from the vaporous coker effluent may be recycled to the coker or the coker may be operated in a once-through manner, that is, without recycle of the heavy material to the coker.

A stream of stripped coke (commonly called cold coke) is withdrawn from the coker by line 20 and introduced into a fluid bed of hot cake having a level 30 in heater 2. The heater may be operated as a conventional coke burner such as disclosed in U.S. Pat. No. 2,881,130, which is hereby incorporated by reference. When the heater is operated as a burner, an oxygen-containing gas, typically air, is introduced into heater 2 by line 22. The combustion of a portion of the solid carbonaceous deposition on the solids with the oxygen-containing gas provides the heat required to heat the colder particles. The temperature in the heating zone (burning zone) is maintained in the range of about 1200° to about 1700° F. Alternatively, heater 2 can be operated as a heat exchange zone such as disclosed in U.S. Pat. Nos. 3,661,543; 3,702,516 and 3,759,676, the teachings of which are hereby incorporated by reference. Hot coke is removed from the fluidized bed in heater 2 and recycled to the coking reactor by line 26 to supply heat thereto.

The following example is presented to illustrate the invention.

EXAMPLE

Comparative experiments were made with a vacuum residuum feed having an atmospheric pressure boiling point above about 1000° F. and a Conradson carbon content of 22 weight percent. One experiment was made without the addition of any small particles to the feed (herein designated experiment A), and another experiment was made in which 2 weight percent coke particles of less than 44 microns in diameter were added to the feed, herein designated experiment B, which is an experiment in accordance with the present invention. The conditions used and the results of these experiments are summarized in the following table:

TABLE

| Run No. | A | B |
|---|---|---|
| Added particles | None | Coke |
| Particle size | — | Less than 44 microns |
| Minimum operable reactor temperature, °F. | 930 | 934 |
| Feed rate, gm/minute | 10.2 | 16.5 |

As can be seen from the above table, the addition of small inert particles in an amount of at least 2 weight percent on oil provided an increased feed rate without significantly increasing temperature thereby maintaining the same product selectivity at the higher feed rate. Alternatively, the coking reaction can be conducted at a lower temperature than would be possible with otherwise the same conditions while increasing liquid yield.

What is claimed is:

1. In a fluid coking process comprising the steps of: contacting a hydrocarbonaceous oil chargestock having a Conradson carbon content of at least about 5 weight percent with hot fluidized solids in a fluidized coking bed contained in a coking zone maintained in a fluidized state by the introduction of a fluidizing gas and operated at coking conditions, to produce a vapor phase product and a solid carbonaceous material which deposits on said fluidized solids, the improvement which comprises adding to said chargestock inert solid particles in an amount sufficient to provide from about 2 to about 10 weight percent total solids, based on said oil prior to introducing said chargestock into said coking zone.

2. The process of claim 1 wherein said inert solid particles are added in an amount sufficient to provide from about 2 to about 5 weight percent total solids, based on said oil.

3. The process of claim 1 wherein said inert solid particles have a size under about 74 microns in diameter.

4. The process of claim 1 wherein said inert particles are selected from the group consisting of coke, siliceous materials, and mixtures thereof.

5. The process of claim 1 wherein said inert particles are coke particles derived from coking a hydrocarbonaceous oil.

6. The process of claim 1 wherein said coking conditions include a temperature ranging from about 850° to about 1400° F.

7. The process of claim 1 wherein said coking conditions include a temperature ranging from about 900° to about 1200° F.

8. The process of claim 1 wherein said coking conditions include a pressure ranging from about 0 to about 150 psig.

9. The process of claim 1 wherein said hot fluidized solids in said fluidized coking bed are coke particles.

* * * * *